US009259080B1

(12) United States Patent
Knight

(10) Patent No.: US 9,259,080 B1
(45) Date of Patent: Feb. 16, 2016

(54) APPARATUS FOR A HANDRAIL SYSTEM HAVING RAILINGS

(71) Applicant: Bradly Jonathan Edward Knight, Calgary (CA)

(72) Inventor: Bradly Jonathan Edward Knight, Calgary (CA)

( * ) Notice: Subject to any disclaimer, the term of this patent is extended or adjusted under 35 U.S.C. 154(b) by 0 days.

(21) Appl. No.: 14/452,742

(22) Filed: Aug. 6, 2014

(51) Int. Cl.

| | |
|---|---|
| ***A47B 23/00*** | (2006.01) |
| ***A47B 5/04*** | (2006.01) |
| ***E04F 11/18*** | (2006.01) |
| ***A47B 13/00*** | (2006.01) |

(52) U.S. Cl.
CPC ..... *A47B 5/04* (2013.01); *A47B 13/003* (2013.01); *E04F 11/18* (2013.01); *E04F 2011/1868* (2013.01)

(58) Field of Classification Search
CPC ..... A47B 5/04; A47B 5/02; A47B 5/00; A47B 96/02; A47B 96/027; A47B 96/061
USPC ..... 108/4, 152, 40, 482; 211/90.01, 90.02, 211/88.01, 86.01, 87.01; 248/235, 240, 248/241, 242, 238, 205.1
See application file for complete search history.

(56) References Cited

U.S. PATENT DOCUMENTS

| | | | | | |
|---|---|---|---|---|---|
| 2,536,731 | A | * | 1/1951 | Douglas | 4/547 |
| 4,570,803 | A | | 2/1986 | Peterson | |
| 4,889,057 | A | * | 12/1989 | Chartrand | 108/42 |
| D318,390 | S | * | 7/1991 | Murray | D6/513 |
| 5,421,131 | A | | 6/1995 | Heckman et al. | |
| 5,469,794 | A | | 11/1995 | Laderoute et al. | |
| 5,528,993 | A | * | 6/1996 | Vincelli | 108/48 |
| D376,708 | S | * | 12/1996 | Robertson et al. | D6/574 |
| 5,653,178 | A | * | 8/1997 | Huczka | 108/47 |
| 5,709,155 | A | * | 1/1998 | Terracciano | 108/42 |
| 6,931,998 | B1 | * | 8/2005 | Leese | 108/42 |
| 7,121,213 | B2 | * | 10/2006 | Viazanko et al. | 108/42 |
| 7,210,414 | B1 | * | 5/2007 | Barone | 108/42 |
| 7,966,948 | B1 | * | 6/2011 | Galietti | 108/42 |
| 8,479,664 | B2 | * | 7/2013 | Nelson | 108/42 |
| 8,561,550 | B2 | | 10/2013 | Raml | |
| 2004/0112258 | A1 | * | 6/2004 | Fichman | 108/42 |
| 2009/0000523 | A1 | | 1/2009 | Ciardelli | |
| 2013/0062481 | A1 | | 3/2013 | Petrakis | |

FOREIGN PATENT DOCUMENTS

| | | |
|---|---|---|
| CA | 1319601 | 6/1993 |
| CA | 2132079 | 12/1999 |
| CN | 101176593 | 5/2008 |

* cited by examiner

*Primary Examiner* — Jose V Chen
(74) *Attorney, Agent, or Firm* — Giuseppe Mariconda

(57) ABSTRACT

An apparatus for a handrail system having railings; the apparatus includes: a rail-mountable assembly; a table assembly having a table surface; a sub-mount assembly; a folding assembly; and an interlocking bracket assembly, including a first mounting bracket configured to be fixedly connected to the rail-mountable assembly and a second mounting bracket configured to be fixedly connected to the sub-mount assembly. The first mounting bracket and the second mounting bracket are configured to be selectively engageable with each other.

20 Claims, 16 Drawing Sheets

APPARATUS FOR A HANDRAIL SYSTEM HAVING RAILINGS

TECHNICAL FIELD

Some aspects generally relate to (and are not limited to) an apparatus for a handrail system having railings, and apparatus 100 includes (for example) a table assembly having a table surface.

SUMMARY

In view of the foregoing, it will be appreciated that there exists a need to mitigate (at least in part) problems associated with existing tables configured for operative connection to a handrail system having railings.

In order to mitigate, at least in part, the problem(s) identified with existing tables configured for operative connection to a handrail system having railings, there is provided (in accordance with an aspect) an apparatus for a handrail system having railings, the apparatus comprising: a rail-mountable assembly configured to be fixedly connected to a selected length of the railings of the handrail system; a table assembly having a table surface; a sub-mount assembly; a folding assembly configured to be fixedly connected to the table assembly, and also configured to be fixedly connected to the sub-mount assembly; and an interlocking bracket assembly, including: a first mounting bracket configured to be fixedly connected to, and project from, the rail-mountable assembly; and a second mounting bracket configured to be fixedly connected to, and project from, the sub-mount assembly; and the first mounting bracket and the second mounting bracket configured to be selectively engageable with each other.

In order to mitigate, at least in part, the problem(s) identified with existing tables configured for operative connection to a handrail system having railings, there is provided (in accordance with an aspect) an apparatus for a handrail system having railings; the apparatus includes (and is not limited to): (A) a rail-mountable assembly configured to be fixedly connected to a selected length of the railings of the handrail system; (B) a table assembly having a table surface; (C) a sub-mount assembly; (D) a folding assembly configured to be fixedly connected to the table assembly, and also configured to be fixedly connected to the sub-mount assembly, and also configured to permit selective foldable movement of the table assembly between a table-deployment position and a table-storage position in response to the folding assembly receiving an application of a force to do just so; in the table-storage position, the table assembly is moved (folded) towards the sub-mount assembly in such a way that space underneath the table assembly is reduced at least in part; and in the table-deployment position, the table assembly is moved (folded) away from the sub-mount assembly in such a way that space underneath the table assembly is increased at least in part; and (E) an interlocking bracket assembly, including: a first mounting bracket configured to be fixedly connected to, and project from, the rail-mountable assembly; and a second mounting bracket configured to be fixedly connected to, and project from, the sub-mount assembly; and the first mounting bracket and the second mounting bracket are configured to be selectively engageable with each other.

In order to mitigate, at least in part, the problem(s) identified above, in accordance with an aspect, there is provided other aspects as identified in the claims.

Other aspects and features of the non-limiting embodiments may now become apparent to those skilled in the art upon review of the following detailed description of the non-limiting embodiments with the accompanying drawings.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
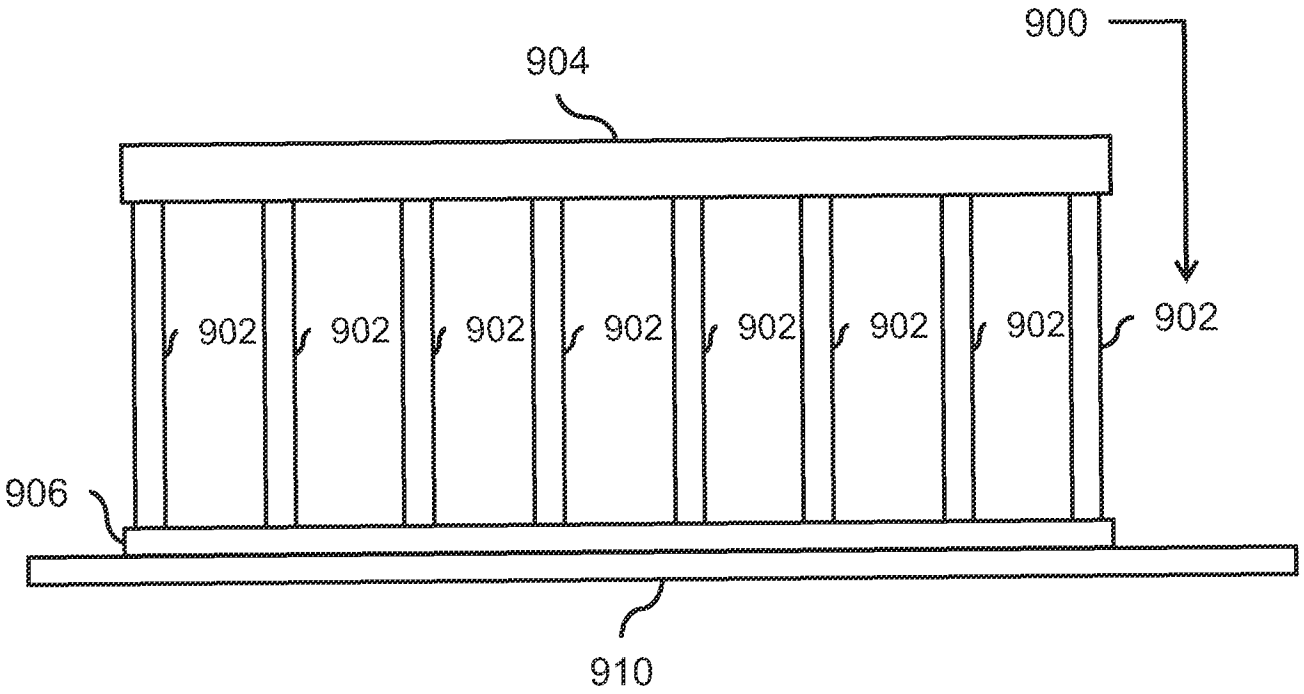
FIG. 1 (SHEET 1 of 16 SHEETS) depicts a front view of an embodiment of a handrail system having railings.

The drawings are not necessarily to scale and may be illustrated by phantom lines, diagrammatic representations and fragmentary views. In certain instances, details not necessary for an understanding of the embodiments (and/or details that render other details difficult to perceive) may have been omitted.

Corresponding reference characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating an understanding of the various presently disclosed embodiments. In addition, common, but well-understood, elements that are useful or necessary in commercially feasible embodiments are often not depicted in order to facilitate a less obstructed view of the various embodiments of the present disclosure.

LISTING OF REFERENCE NUMERALS USED IN THE DRAWINGS

100 apparatus
102 rail-mountable assembly
104 table assembly
106 table surface
108 folding assembly
109 slot
110 sub-mount assembly
111 stop portion
112 interlocking bracket assembly
113 side rails
114 first mounting bracket
115 opening
116 second mounting bracket
117 fastening holes
119 base portion
121 base portion
123 fastening holes
124 fastening holes
125 side rails
127 first folding portion
128 fastening holes
129 second folding portion
131 pivot
133 table-facing side
137 slot
139 mounting clip
141 hole

143 coupling nut
145 carriage bolt
146 fastening holes
147 mounting hardware
149 connector
151 hex portion
900 handrail system
902 railings
904 horizontal hand rail
906 rail
910 floor

DETAILED DESCRIPTION OF THE EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of the description herein, the terms "upper," "lower," "left," "rear," "right," "front," "vertical," "horizontal," and derivatives thereof shall relate to the examples as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments (examples), aspects and/or concepts defined in the appended claims. Hence, specific dimensions and other physical characteristics relating to the embodiments disclosed herein are not to be considered as limiting, unless the claims expressly state otherwise. It is understood that "at least one" is equivalent to "a". The aspects (examples, alterations, modifications, options, variations, embodiments and any equivalent thereof) are described with reference to the drawings. It should be understood that the invention is limited to the subject matter provided by the claims, and that the invention is not limited to the particular aspects depicted and described.

FIG. 1 depicts a front view of an embodiment of a handrail system 900 having railings 902.

In accordance with the embodiment of FIG. 1, the handrail system 900 includes railings 902, a horizontal hand rail 904, and a horizontal foot rail 906. The railings 902 are also called vertically-extending rail members or rail struts. The handrail system 900 is configured to be operatively mounted to a floor 910 (also called a balcony floor or a working surface). Specifically, the horizontal foot rail 906 is configured to be fixedly attached to the floor 910. Each of the railings 902 is fixedly attached to (and vertically extends from) the horizontal foot rail 906. The railings 902 are spaced apart from each other. The horizontal hand rail 904 is fixedly connected to the top portions of each of the railings 902. The horizontal hand rail 904 and the horizontal foot rail 906 are parallel to each other and are spaced apart from each other.

Figure 2A:
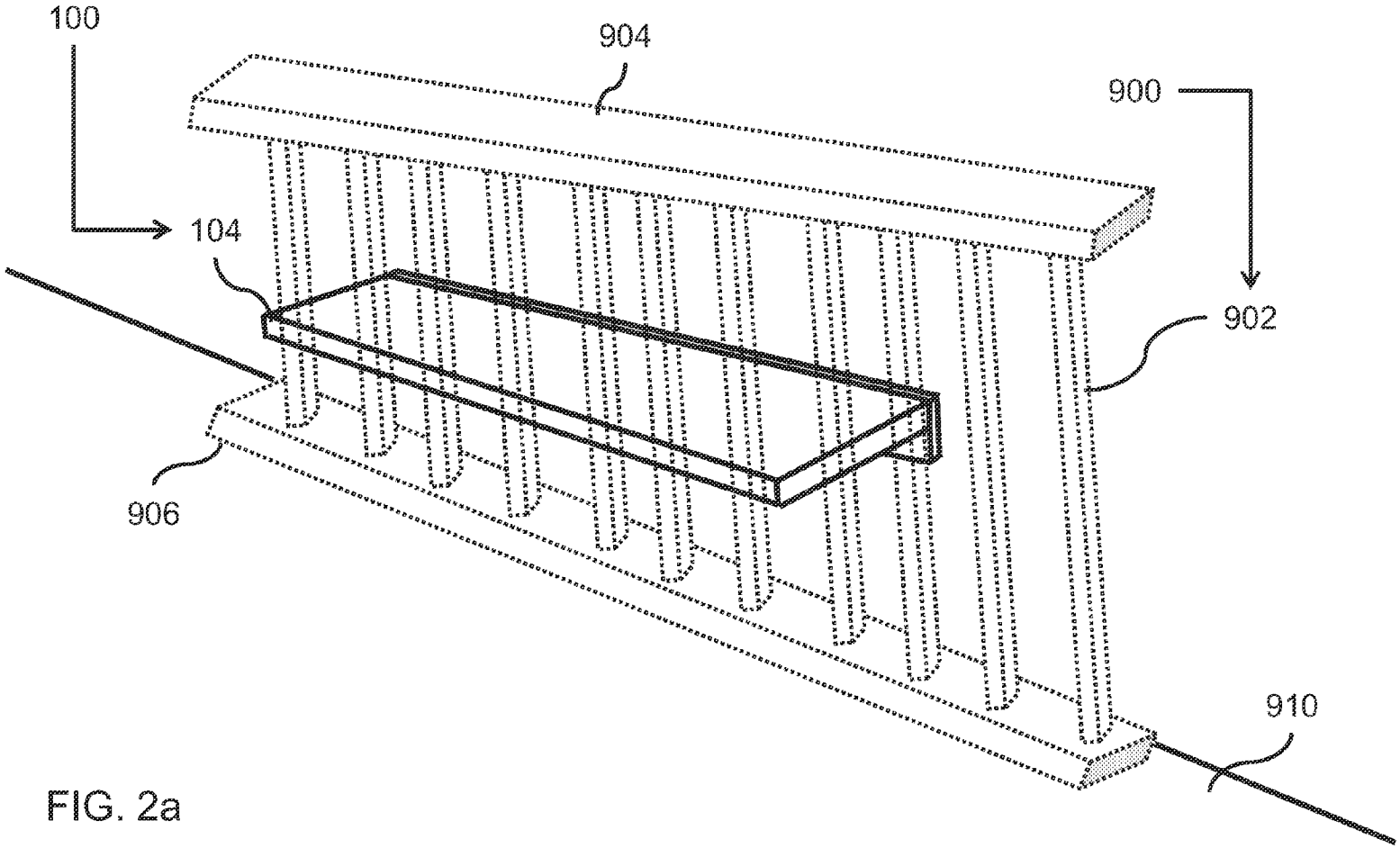
FIGS. 2*a* to 2*c* (SHEETS 2 to 4 of 16 SHEETS) depict perspective views of embodiments of an apparatus for the handrail system having the railings of FIG. 1.
Figure 2B:
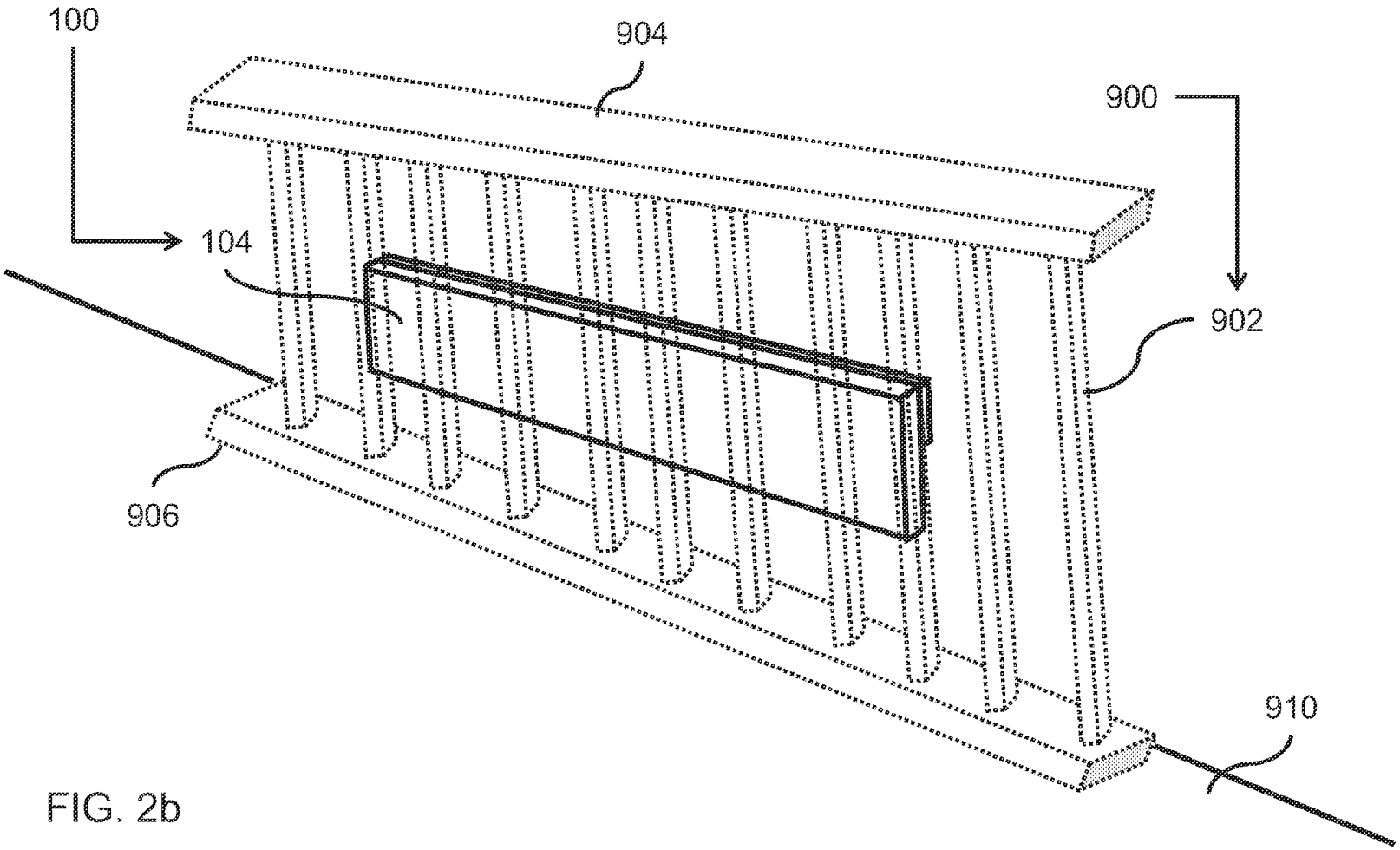
Figure 2C:
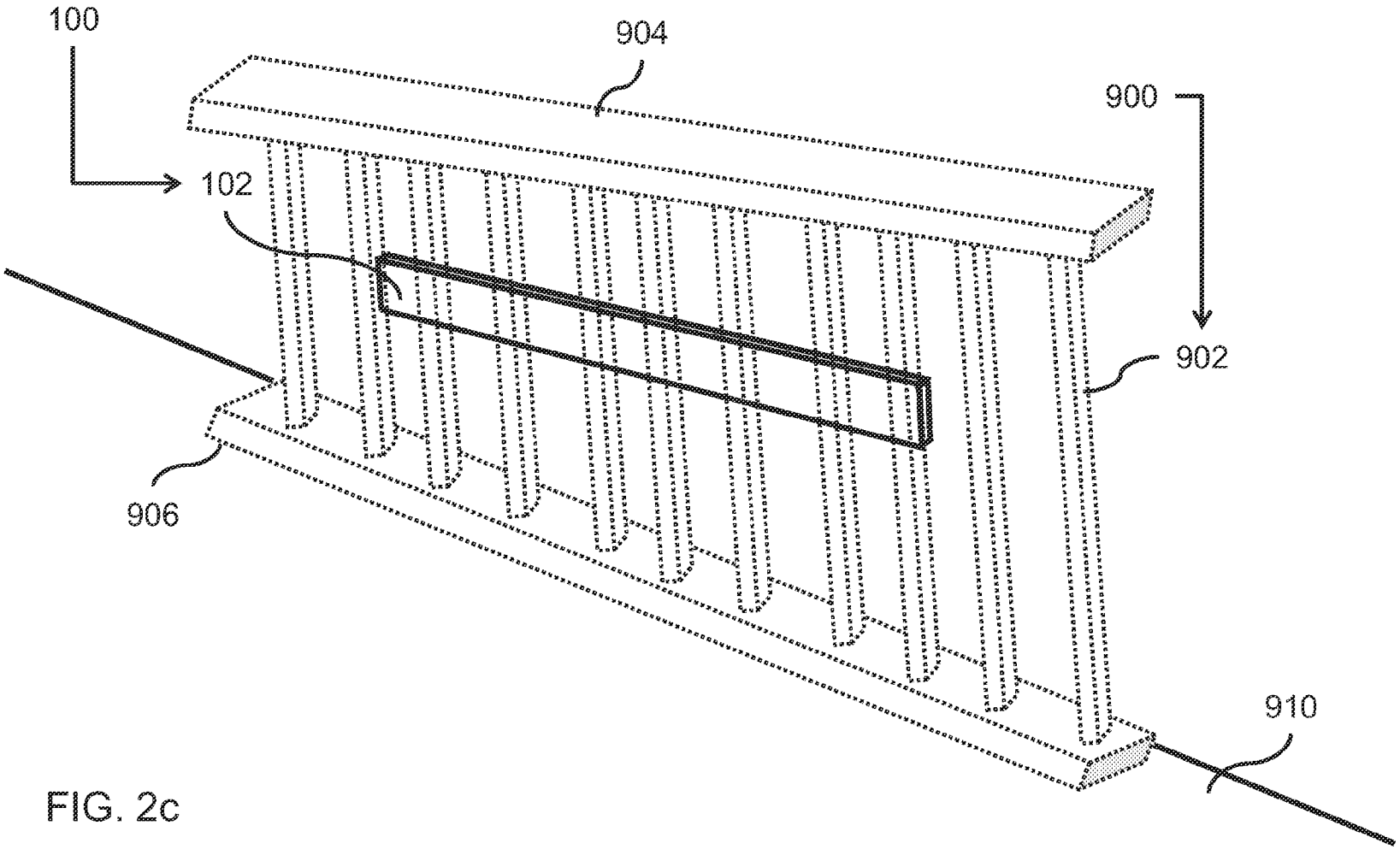

FIGS. 2*a* to 2*c* depict perspective views of embodiments of an apparatus 100 for the handrail system 900 having the railings 902 of FIG. 1.

The apparatus 100 is configured to be operatively mountable to the railings 902. The apparatus 100 includes a table assembly 104. FIG. 2*a* depicts a table-deployment position of the table assembly 104 once the apparatus 100 is operatively mounted to the railings 902. FIG. 2*b* depicts a table-storage position of the table assembly 104 once the apparatus 100 is operatively mounted to the railings 902. FIG. 2*c* depicts the table assembly 104 detached (separated) from a rail-mountable assembly 102; the rail-mountable assembly 102 is configured to be fixedly attached to the railings 902.

Figures 3A, 3B, 3C:
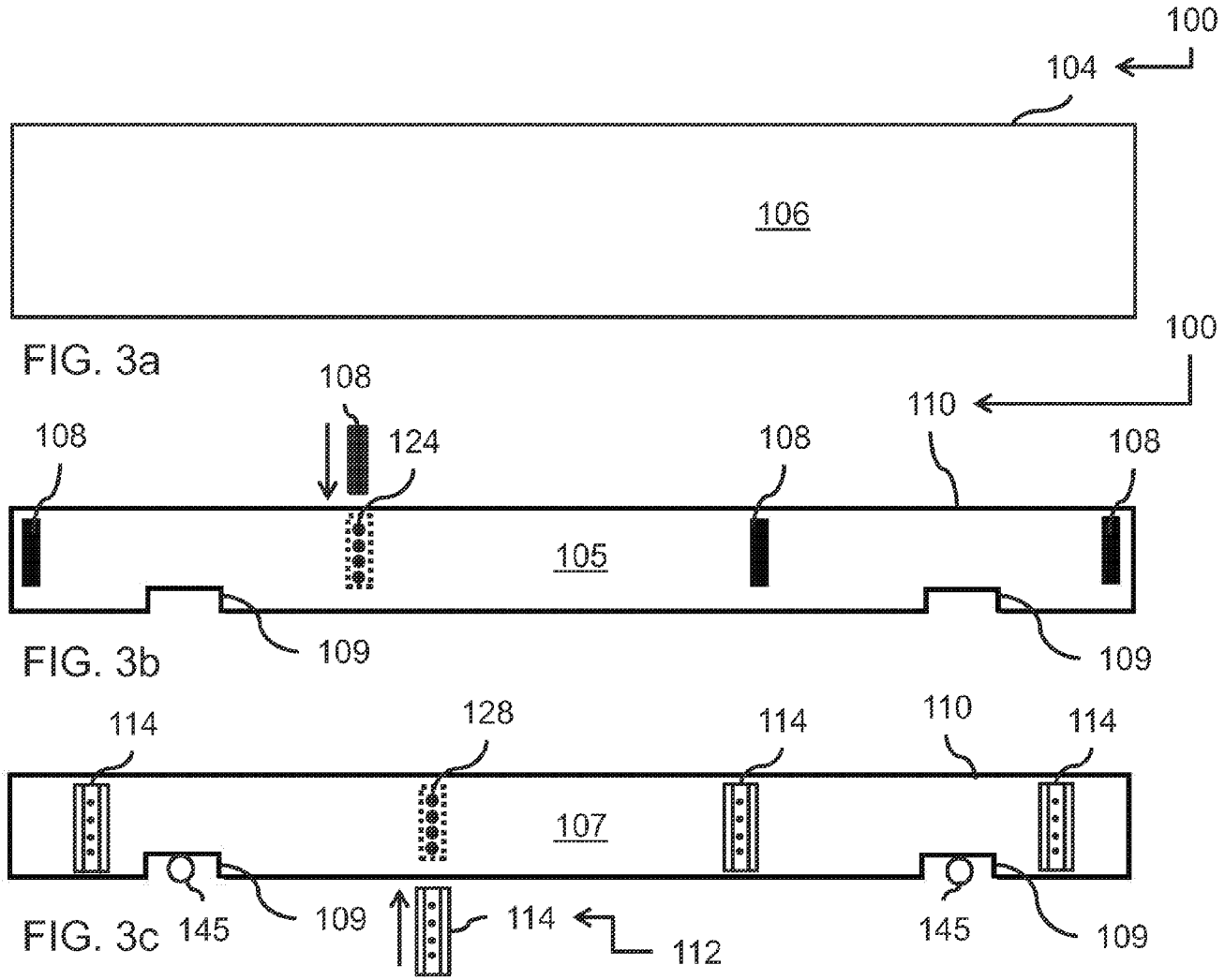
FIGS. 3*a* to 3*o* (SHEETS 5 to 8 of 16 SHEETS) depict views of embodiments of the apparatus of FIGS. 2*a* to 2*c*.
Figure 3E:
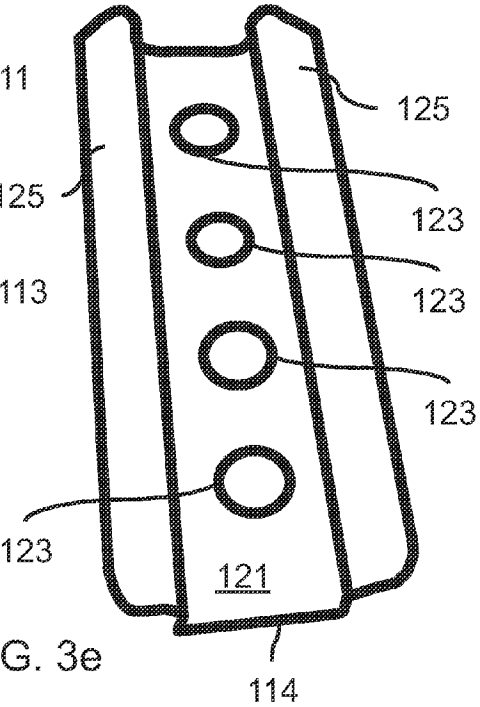
Figure 3D:
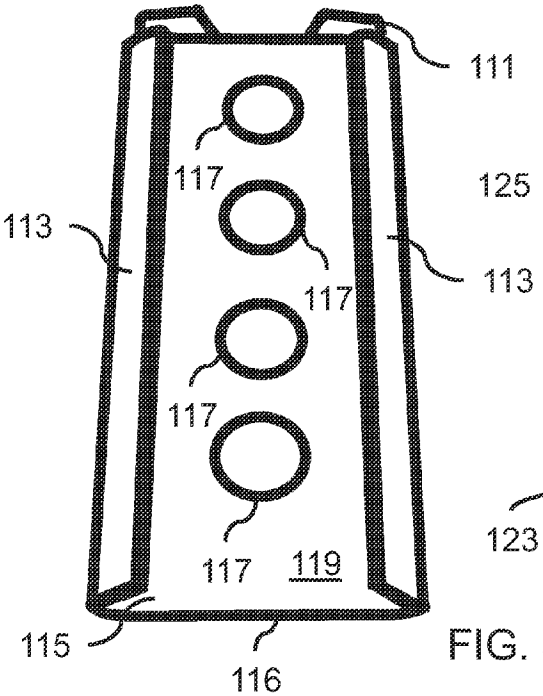
Figure 3D:
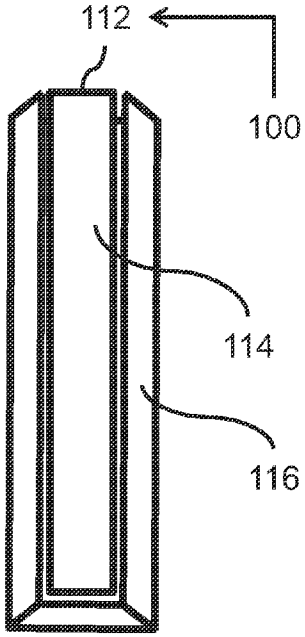
Figure 3H:
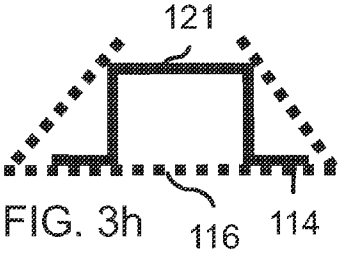
Figure 3G:
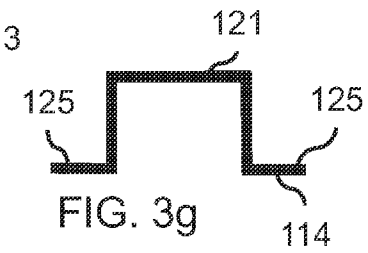
Figure 3F:
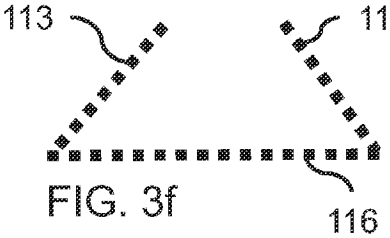
Figure 3J:
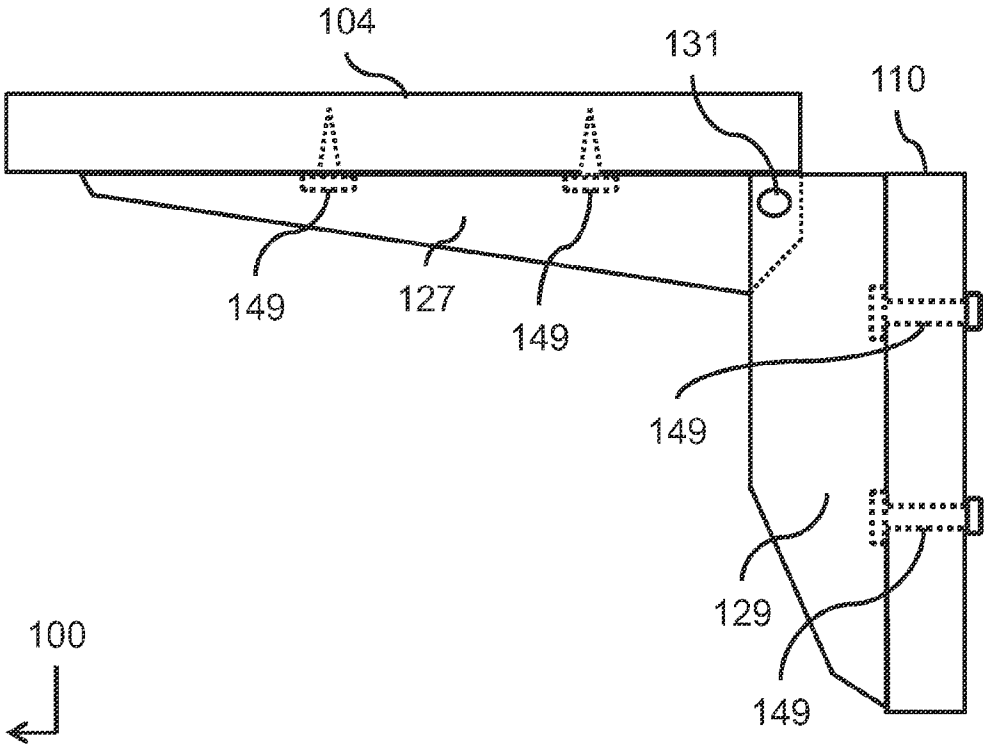
Figure 3I:
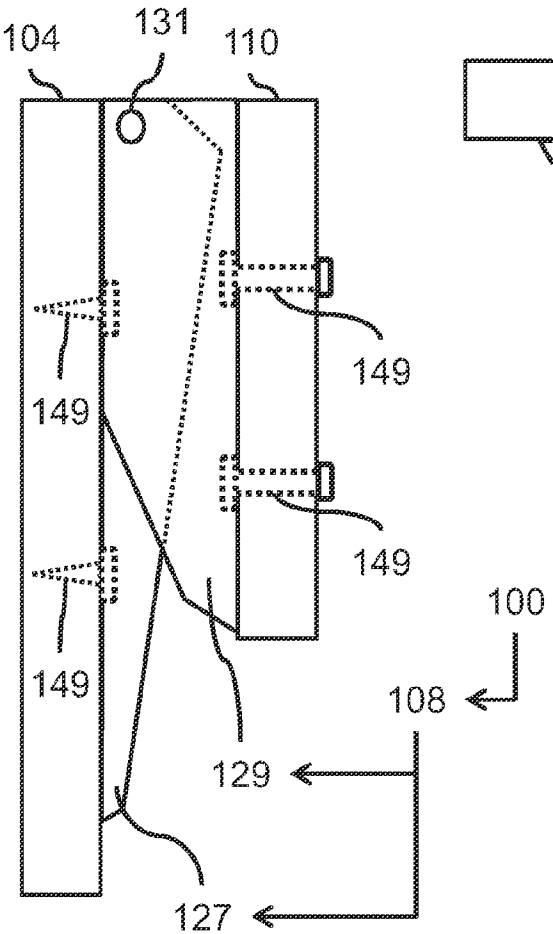
Figures 3K, 3L, 3M, 3N, 3O:
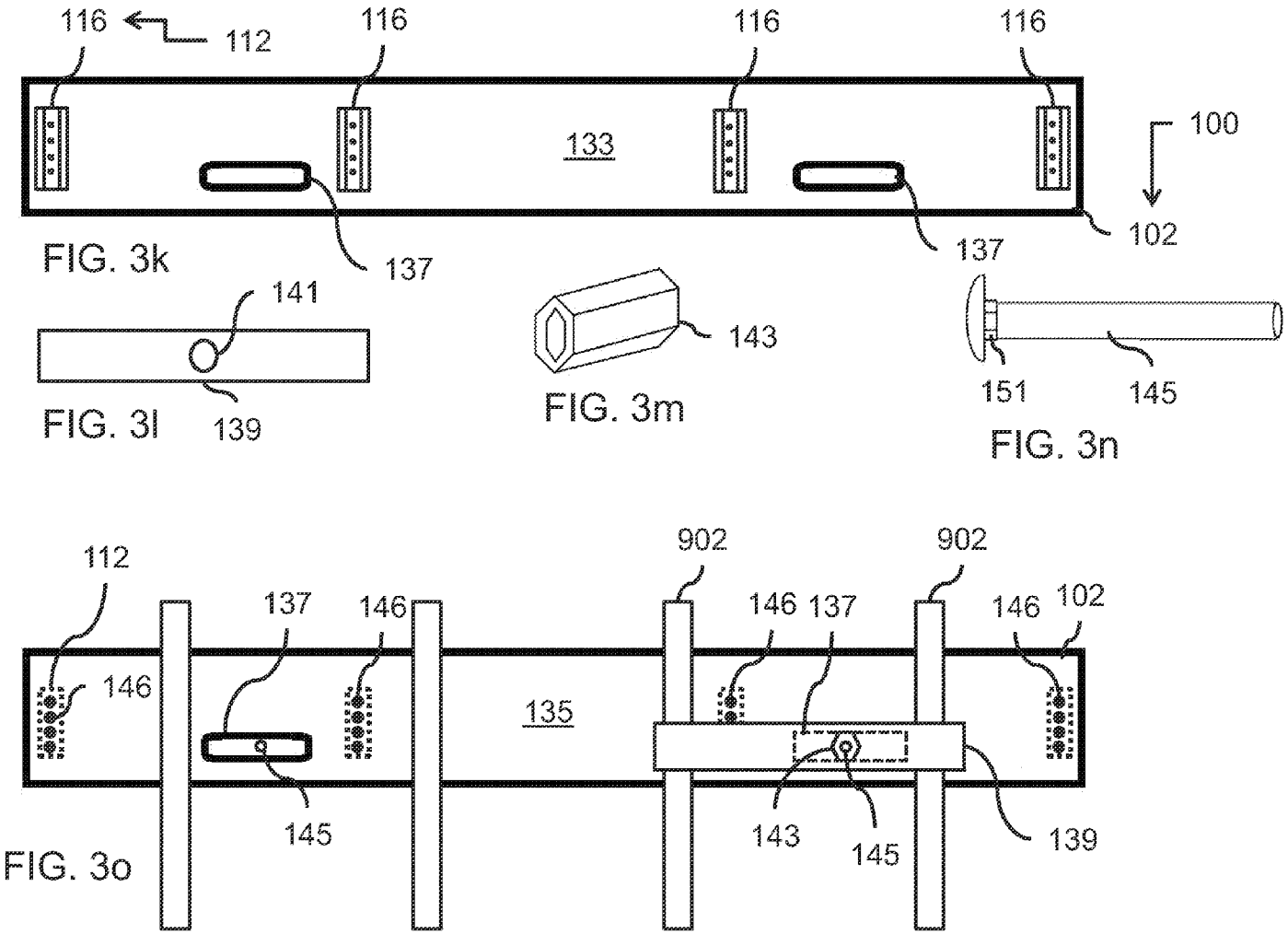

FIGS. 3*a* to 3*o* depict views of embodiments of the apparatus 100 of FIGS. 2*a* to 2*c*.

In accordance with the embodiment depicted in FIG. 3*a* (showing a top view), the apparatus 100 includes a table assembly 104 having a table surface 106. The table surface 106 is configured to receive user items (such as plates, drinking glasses, etc.).

The table assembly 104 is depicted as having a rectangular shape; it will be appreciated that the table assembly 104 may have any desired shape provided that the shape of the table assembly 104 may be operatively fitted with the assemblies of the apparatus 100. The table assembly 104 may be made of or may include any suitable type of material (wood, steel, plastic, etc.).

In accordance with the embodiment depicted in FIGS. 3*b* and 3*c* (showing side views), the apparatus 100 also includes a sub-mount assembly 110. The sub-mount assembly 110 has a length equal to the length of the table assembly 104. The sub-mount assembly 110 has two sides; a first side 105 (depicted in FIG. 3*b*) is for facing the table assembly 104, and a second side 107 (depicted in FIG. 3*c*) is for facing toward the railings 902 of the handrail system 900 of FIG. 1. The sub-mount assembly 110 is depicted as having a rectangular shape; it will be appreciated that the sub-mount assembly 110 may have any desired shape provided that the shape of the sub-mount assembly 110 may be operatively fitted with the assemblies of the apparatus 100. The sub-mount assembly 110 may be made of or may include any suitable type of material (wood, steel, plastic, etc.).

In accordance with the embodiment depicted in FIG. 3*b* (showing a side view), the apparatus 100 also includes a folding assembly 108 (which is also called a hinge assembly or a hinge device). As depicted, there are four instances of the folding assembly 108. It will be appreciated that the number of instances of the folding assembly 108 may vary depending on the length of the table assembly 104 of FIG. 3*a* and other factors such as the weight of the table assembly 104, the weight to be operatively supported by the table assembly 104, etc. The instances of the folding assembly 108 are spaced apart (evenly) from each other along the length of the sub-mount assembly 110. Each instance of the folding assembly 108 is configured to be fixedly connected to the first side 105 of the sub-mount assembly 110. An example of the folding assembly 108 is manufactured by EVERBILT Model 859-806 Folding Shelf Bracket (and any equivalent bracket). The folding assembly 108 may be snap-clicked into and opened position and/or a closed position (if so desired). The folding assembly 108 may be made of or may include any suitable type of material (steel, plastic, etc.). Fastening holes 124 are defined by the sub-mount assembly 110, and the fastening holes 124 are configured to interface with fastening holes (not depicted) of the folding assembly 108: in this manner, the folding assembly 108 may be bolted (fixedly attached) to the sub-mount assembly 110 (once the fastening holes are aligned with each other).

In accordance with the embodiment depicted in FIG. 3*c* (showing a side view), the apparatus 100 also includes an interlocking bracket assembly 112 (what is specifically depicted is a first mounting bracket 114 of the interlocking bracket assembly 112 of FIG. 3*e*). As depicted, there are four instances of the interlocking bracket assembly 112. It will be appreciated that the number of instances of the interlocking bracket assembly 112 may vary depending on the length of the table assembly 104 of FIG. 3*a* and other factors such as the weight of the table assembly 104, the weight to be operatively supported by the table assembly 104, etc. The instances of the interlocking bracket assembly 112 are spaced apart (evenly) from each other along the length of the sub-mount assembly 110. Each instance of the interlocking bracket assembly 112 is configured to be fixedly connected to (and project from) the second side 107 of the sub-mount assembly 110. In accordance with an option, the sub-mount assembly 110 defines a slot 109 (also called a groove, etc.). The slot 109 is configured to receive, at least in part, a carriage bolt 145 (depicted in FIG. 3*n*) for the case where the carriage bolt 145 is long enough to interfere with the sub-mount assembly 110 if the slot 109 were not present. The fastening holes 128 are defined by the sub-mount assembly 110, and are configured to interface with the fastening holes 117 (depicted in FIG. 3*e*) of an interlocking bracket assembly 112 (or to the fastening holes 123 of the interlocking bracket assembly 112 if so desired); in this manner, the interlocking bracket assembly 112 may be bolted (fixedly attached) to the sub-mount assembly 110 (once the fastening holes are aligned with each other). The interlocking bracket assembly 112 is configured to be fixedly connected to (and project orthogonally from) the second side 107 of the sub-mount assembly 110. The first mounting bracket and the second mounting bracket are configured to be selectively engageable (such as, side engageable) with each other and also disengageable (such as, slide disengageable) with (from) each other.

In accordance with the embodiment depicted in FIGS. 3*d* (showing a top perspective view) and 3*e* (showing a perspective view), the apparatus 100 also includes the interlocking bracket assembly 112. The interlocking bracket assembly 112 includes a first mounting bracket 114 and a second mounting bracket 116. For instance, the first mounting bracket 114 is configured to be fixedly connected to (and project from) the sub-mount assembly 110 of FIG. 3*b*. More specifically, the first mounting bracket 114 is configured to be fixedly connected to (and project orthogonally from) the sub-mount assembly 11. For instance, the second mounting bracket 116 is configured to be fixedly connected (and project from) to the rail-mountable assembly 102 of FIG. 3*k*. The first mounting bracket 114 may be called a male portion. The second mounting bracket 116 may be called a female portion. The first mounting bracket 114 and the second mounting bracket 116 are configured to be selectively engageable with each other. The first mounting bracket 114 and the second mounting bracket 116 are configured to be selectively disengageable from each other. More specifically, the first mounting bracket 114 and the second mounting bracket 116 are configured to be selectively slide engageable (selectively interlockable) with each other between an engaged position (also may be called a locked position) and a disengaged position (also may be called an unlocked position). FIG. 3*d* depicts the first mounting bracket 114 and the second mounting bracket 116 slide-engaged with each other in the engaged position. FIG. 3*e* depicts the first mounting bracket 114 and the second mounting bracket 116 in which they are not slide-engaged with each other in the disengaged position.

In accordance with the embodiment of FIG. 3*e* (showing a perspective view), the second mounting bracket 116 includes a stop portion 111 positioned at a distal end of the second mounting bracket 116. The second mounting bracket 116 also includes longitudinal side rails 113 positioned on opposite sides of the second mounting bracket 116, and the stop portion 111 is positioned at the end of the longitudinal side rails 113. An opening 115 is defined at an end located opposite to the stop portion 111, and the opening 115 is positioned at another end of the longitudinal side rails 113 opposite from the stop portion 111. The second mounting bracket 116 also includes a base portion 119 that extends between the longitudinal side rails 113. The base portion 119 defines fastening holes 117. It will be appreciated that the number of instances of the fastening holes 117 may vary depending on the weight to be supported by the table assembly 104 of FIG. 3*a*. The fastening holes 117 are aligned one after the other along a row.

In accordance with the embodiment of FIG. 3*e* (showing a perspective view), the first mounting bracket 114 includes a base portion 121 defining four instances of fastening holes 123 that are aligned one after the other along a row. It will be appreciated that the number of instances of the fastening holes 123 may vary depending on the weight to be supported by the table assembly 104 of FIG. 3*a*. The first mounting bracket 114 also includes longitudinal side rails 125 that extend from opposite sides of the base portion 121 in such a way as to form a U shaped profile. The opposite ends of the longitudinal side rails 125 define openings. The longitudinal side rails 125 and the longitudinal side rails 113 are configured to be slide engageable with each other. The first mounting bracket 114 has longitudinal side rails 125. The second mounting bracket 116 has longitudinal side rails 113. The longitudinal side rails 125 and the longitudinal side rails 113 are slide engageable with each other.

The first mounting bracket 114 and the second mounting bracket 116 are slide engageable with each other in such a way that the rail-mountable assembly 102 and the second mounting bracket 116 are engaged with each other in an engagement position (depicted in FIGS. 4*e*, 4*f*, 4*g*) in which the first mounting bracket 114 remains fixedly connected to the rail-mountable assembly 102, the second mounting bracket 116 remains fixedly connected to the sub-mount assembly 110, and the rail-mountable assembly 102 and the second mounting bracket 116 are engaged with each other.

The first mounting bracket 114 and the second mounting bracket 116 are slide engageable with each other in such a way that the rail-mountable assembly 102 and the second mounting bracket 116 are disengaged from each other in a disengagement position (depicted in FIG. 4*h*) in which the first mounting bracket 114 remains fixedly connected to the rail-mountable assembly 102, the second mounting bracket 116 remains fixedly connected to the sub-mount assembly 110, and the rail-mountable assembly 102 and the second mounting bracket 116 are disengaged with each other.

The second mounting bracket 116 provides the stop portion 111, which is a load-bearing (horizontally-aligned) support configured to support an edge portion of the first mounting bracket 114 (as depicted in FIG. 3*e*).

The first mounting bracket 114 and the second mounting bracket 116 each project from a vertically-aligned structure (once fixedly mounted to do just so), and is configured to support a vertical load.

In accordance with the embodiments of FIGS. 3*f*, 3*g* and 3*h* (showing cross-sectional views), the first mounting bracket 114 forms a generally U-shaped profile (or a U-shaped cross-section), and the second mounting bracket 116 forms a generally C-shaped profile (or a C-shaped cross-section). FIG. 3*h* depicts the first mounting bracket 114 and the second mounting bracket 116 that are slide-engaged with each other in an engaged position. FIGS. 3*f* and 3*g* depict the first mounting bracket 114 and the second mounting bracket 116 that are not slide-engaged with each other in a disengaged position.

In accordance with the embodiment of FIGS. 3*i* and 3*j* (showing side views), the apparatus 100 includes the folding assembly 108. The folding assembly 108 includes a first folding portion 127 and a second folding portion 129. The first folding portion 127 of the folding assembly 108 is configured to be fixedly connected to the table assembly 104. The second folding portion 129 of the folding assembly 108 is also configured to be fixedly connected to the sub-mount assembly 110. The first folding portion 127 and the second folding portion 129 are pivotally connected together at a pivot 131. The first folding portion 127 and the second folding portion 129 are configured to be pivotally movable relative to each other at the pivot 131 between a table-deployment position (as depicted in FIG. 3*j*) and a table-storage position (as depicted in FIG. 3*i*). The first folding portion 127 and the second folding portion 129 are configured to be lockable at the table-deployment position (as depicted in FIG. 3*j*), and in this manner the table assembly 104 cannot inadvertently dislodge and move from the table-deployment position (FIG. 3*j*) to a table-storage position (as depicted in FIG. 3*i*). In accordance with an option, the first folding portion 127 and the second folding portion 129 are configured to be lockable at the table-storage position (as depicted in FIG. 3*i*), if so desired. The folding assembly 108 is configured to permit selective foldable movement of the table assembly 104 between the table-deployment position (as depicted in FIG. 3*j*) and the table-storage position (as depicted in FIG. 3*i*). It will be appreciated that selective foldable movement of the folding assembly 108 may be accomplished in response to the folding assembly 108 receiving an application of a force to do just so. In the table-storage position, the table assembly 104 is moved (such as, folded) towards the sub-mount assembly 110 in such a way that space underneath the table assembly 104 is reduced (at least in part). In the table-deployment position, the table assembly 104 is moved (such as, folded) away from the sub-mount assembly 110 in such a way that space underneath the table assembly 104 is increased, at least in part (and for this case, the table assembly 104 may be used to receive user items, such as plates, cutlery, etc.). The folding assembly 108 is configured to allow for the table assembly 104 to be folded and out of the way for the case where the table assembly 104 is not in use. The folding assembly 108 is configured to fold upwardly to 90 degrees (in a horizontal condition or alignment) and folds back down (in a vertical condition or alignment). In the up position (FIG. 3*j*), the folding assembly 108 is configured to lock in position to form a 90 degree angle between the first folding portion 127 and the second folding portion 129. A connector 149 operatively fixedly connects the second folding portion 129 to the sub-mount assembly 110 (for instance, a bolt and nut may threadably fixedly connect the second folding portion 129 to the sub-mount assembly 110 if so desired, or a pop rivet may be used if desired). The connector 149 operatively fixedly connects the first folding portion 127 to the table assembly 104 (for instance, a screw may threadably fixedly connect the first folding portion 127 to the table assembly 104 if so desired).

In accordance with the embodiment of FIGS. 3*k*, 3*l*, 3*m*, 3*n* and 3*o* (showing side views), the apparatus 100 includes the rail-mountable assembly 102.

FIG. 3*k* depicts a side view of a table-facing side 133 of the rail-mountable assembly 102. The instances of the interlocking bracket assembly 112 are spaced apart and are mounted to the table-facing side 133 of the rail-mountable assembly 102 (what is specifically depicted is the second mounting bracket 116 of the interlocking bracket assembly 112 of FIG. 3*e*). The rail-mountable assembly 102 defines a set of slots 137 that are spaced apart from each other and aligned in a row with each other. The rail-mountable assembly 102 is depicted as having a rectangular shape; it will be appreciated that the rail-mountable assembly 102 may have any desired shape provided that the shape of the rail-mountable assembly 102 may be operatively fitted with the assemblies of the apparatus 100. The rail-mountable assembly 102 may be made of or may include any suitable type of material (wood, steel, plastic, etc.).

FIG. 3*o* depicts a side view of a rail-facing side 135 of the rail-mountable assembly 102. The rail-mountable assembly 102 defines fastening holes 146 configured to be aligned with the fastening holes 117 of the second mounting bracket 116 (depicted in FIG. 3*e*) or the fastening holes 123 of the first mounting bracket 114 (depicted in FIG. 3*e*), depending on which of the first mounting bracket 114 or the second mounting bracket 116 is to be mounted to the rail-mountable assembly 102 (depicted in FIG. 3*o*). It will be appreciated that mounting hardware (such as bolts, washers, nuts, lock washers, and any equivalent, etc.) to be used with the fastening holes 146 are not depicted in order to improve the view of the rail-mountable assembly 102. It is understood that the mounting hardware is configured to fixedly connect the interlocking bracket assembly 112 to the rail-mountable assembly 102 via the fastening holes 146 (as would be understood by persons skilled in the art).

FIG. 3*l* depicts a side view of an embodiment in which the rail-mountable assembly 102 includes a mounting clip 139 defining a hole 141. The hole 141 is dimensioned to receive the carriage bolt 145 of FIG. 3*n*.

FIG. 3*m* depicts a side view of an embodiment in which the rail-mountable assembly 102 includes a coupling nut 143 configured to connect the carriage bolt 145 of FIG. 3*n* with the mounting clip 139 of FIG. 3*l*. The coupling nut 143 includes a hole or passage defining threads therein.

FIG. 3*n* depicts a side view of an embodiment in which the rail-mountable assembly 102 includes a carriage bolt 145. The carriage bolt 145 includes shaft portion defining threads configured to mate with the threads provided by the coupling nut 143. The carriage bolt 145 also includes a flared head portion extending from the shaft portion. A hex portion 151 extends from a head portion (rounded head portion) of the carriage bolt 145. It will be appreciated that the operation of the hex portion 151 is described in connection with the description of FIG. 4*c*.

FIG. 3*o* depicts a side view of an embodiment in which the mounting clip 139, the coupling nut 143 and the carriage bolt 145, in combination, are configured to fixedly connect the rail-mountable assembly 102 of FIG. 3*k* to the railings 902 of FIG. 1. The mounting clip 139 may be coated with a rubber compound in order to avoid inadvertent or unwanted marring of the railings 902. The carriage bolt 145 passes through the slot 137 of the rail-mountable assembly 102. The flared head portion of the carriage bolt 145 abuts the table-facing side 133 of the rail-mountable assembly 102. The shaft portion of the carriage bolt 145 extends through the slot 137. The mounting clip 139 is positioned on a selected length of the railings 902. The mounting clip 139 is configured to span across, and abuts with, at least two adjacently located instances of the railings 902. The shaft portion of the carriage bolt 145 extends through the hole 141 of the mounting clip 139. The coupling nut 143 is threadably connected to the shaft portion of the carriage bolt 145. The coupling nut 143 is turned in such a way that a clamping force is imparted to the mounting clip 139, and the railings 902 are forcibly clamped or sandwiched between the mounting clip 139 and the rail-mountable assembly 102. In this manner, the rail-mountable assembly 102 is configured to be fixedly connected to a selected length of the railings 902 of the handrail system 900. The slot 137 is elongated and is configured to permit accommodation of different types and sizes of the railings 902.

FIGS. 4*a* to 4*g* depict views of embodiments of the apparatus 100 of FIGS. 2*a* to 2*c*.

Figure 4A:
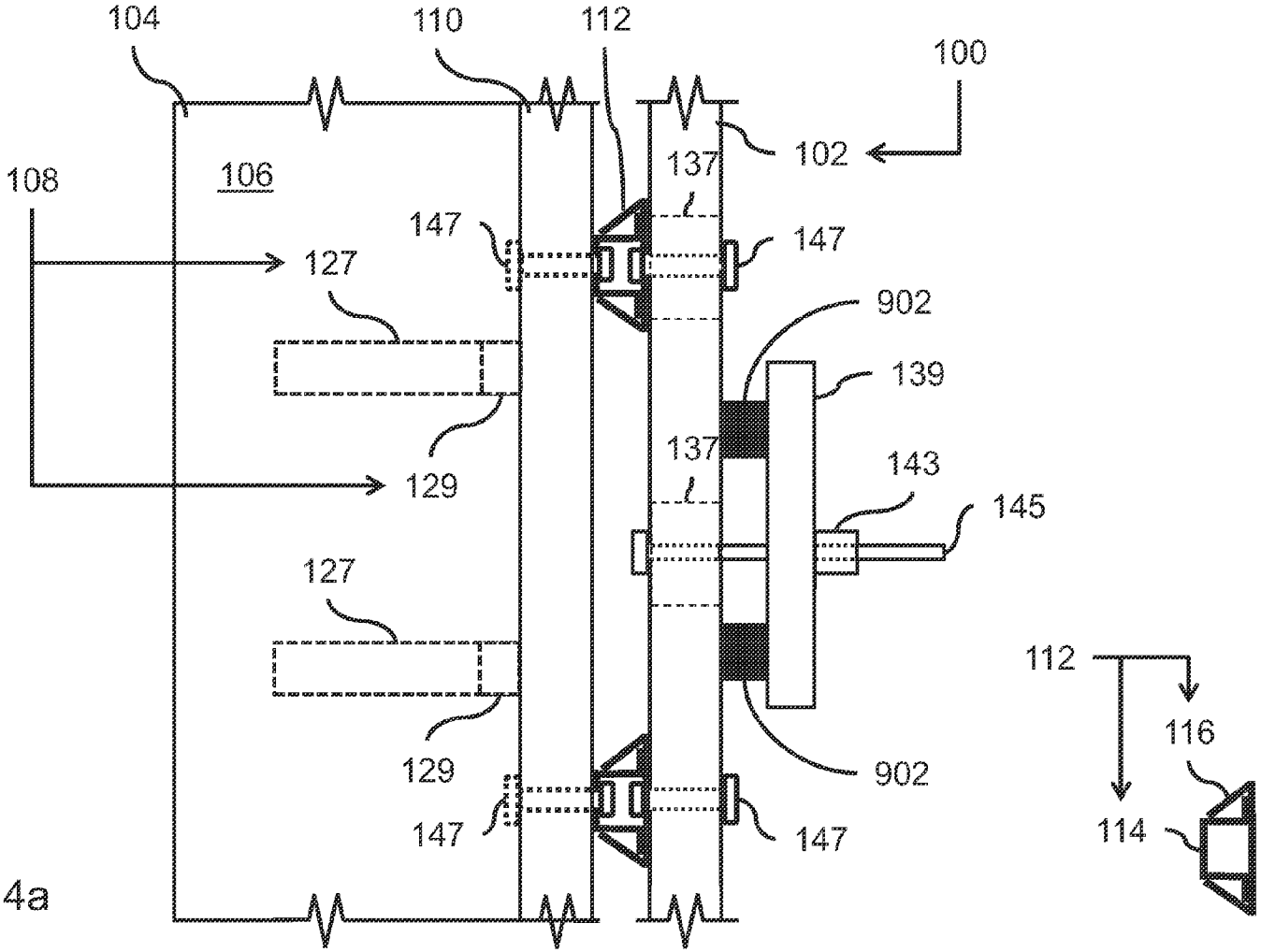
FIGS. 4*a* to 4*h* (SHEETS 9 to 16 of 16 SHEETS) depict views of embodiments of the apparatus of FIGS. 2*a* to 2*c*.
Figure 4B:
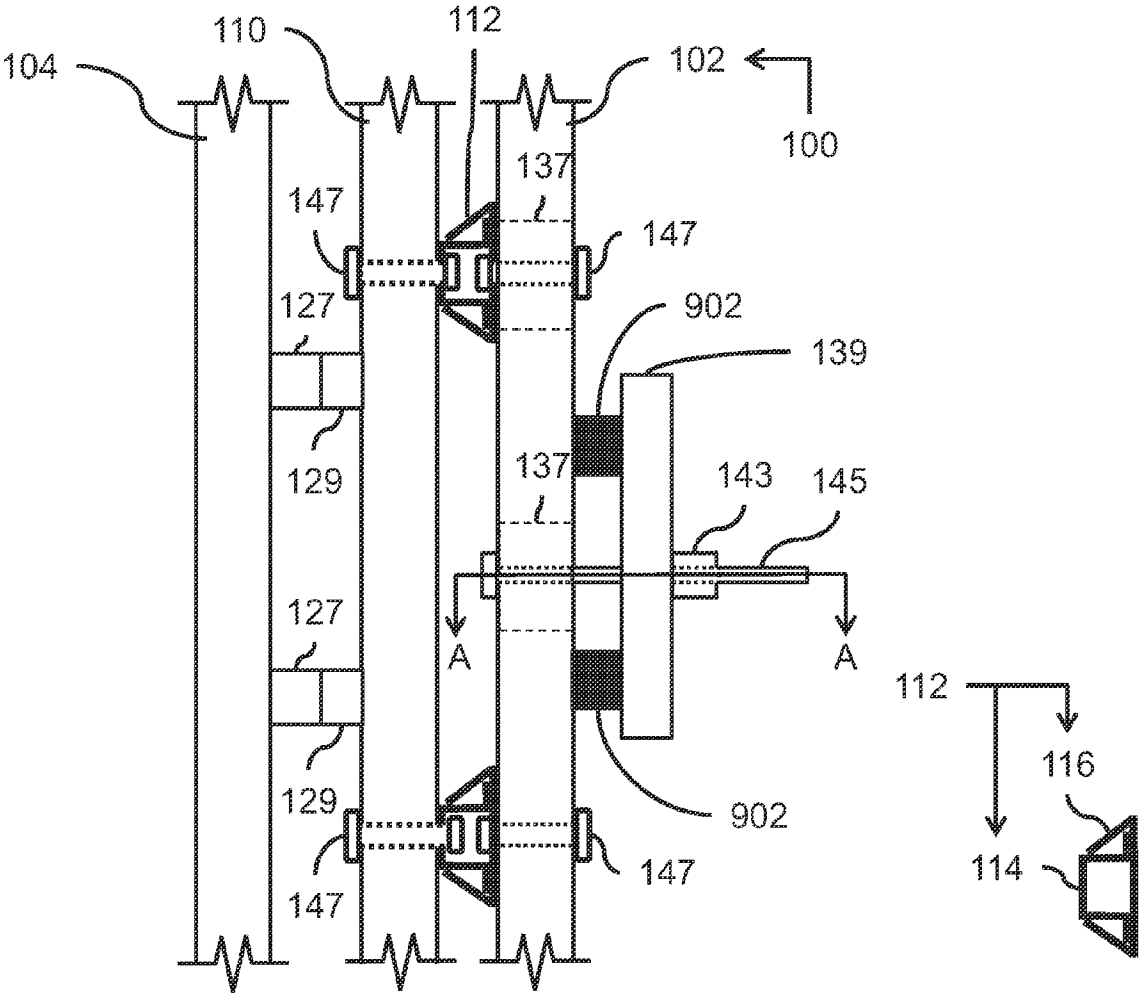

Referring to FIGS. 4*a* and 4*b* (depicting top views), there is depicted an embodiment of the apparatus 100 for the handrail system 900 (depicted in FIGS. 1 and 2) having the railings 902. The apparatus 100 includes (and is not limited to) a combination of: a rail-mountable assembly 102; a table assembly 104; a sub-mount assembly 110; a folding assembly 108; and an interlocking bracket assembly 112.

The rail-mountable assembly 102 is configured to be fixedly connected to a selected length of the railings 902 of the handrail system 900.

The table assembly 104 has a table surface 106.

The folding assembly 108 is configured to be fixedly connected to the table assembly 104. The folding assembly 108 is also configured to be fixedly connected to the sub-mount assembly 110. The folding assembly 108 is also configured to permit selective foldable movement of the folding assembly 108 (and of the table assembly 104) between a table-deployment position (as depicted in FIGS. 4*a* and 4*e*) and a table-storage position (as depicted in FIGS. 4*b*, 4*d* and 4*l*). It will be appreciated that selective foldable movement of the table assembly 104 may be accomplished in response to the folding assembly 108 receiving an application of a force to do just so. In the table-storage position, the table assembly 104 is moved (such as, folded) towards the sub-mount assembly 110 in such a way that space underneath the table assembly 104 is reduced, at least in part (relative to the table-deployment position). In the table-deployment position, the table assembly 104 is moved (such as, folded) away from the sub-mount assembly 110 in such a way that space underneath the table assembly 104 is increased, at least in part (relative to the table-storage position).

The interlocking bracket assembly 112 includes a combination of: a first mounting bracket 114 and a second mounting bracket 116. The first mounting bracket 114 is configured to be fixedly connected to (and project from) the rail-mountable assembly 102. The second mounting bracket 116 is configured to be fixedly connected to (and project from) the sub-mount assembly 110. The first mounting bracket 114 and the second mounting bracket 116 are configured to be selectively slide engageable with each other. The first mounting bracket 114 and the second mounting bracket 116 are configured to transfer weight from the table assembly 104, the folding assembly 108 and the sub-mount assembly 110 toward the rail-mountable assembly 102 and the railings 902 of the handrail system 900. The transfer of the weight is done in such a way that the table assembly 104 remains operatively supported at the table-storage position and at the table-deployment position.

The mounting hardware 147 is configured to fixedly attach the interlocking bracket assembly 112 to the rail-mountable assembly 102. The mounting hardware 147 (such as a bolt and nut, etc.) is configured to fixedly attach the interlocking bracket assembly 112 to the sub-mount assembly 110. For instance, the mounting hardware 147 may be a 0.25 inch bolt with corresponding nuts (or any equivalent mounting hardware). It will be appreciated that there are options for fixedly attaching the interlocking bracket assembly 112. In accordance with the option as depicted in FIGS. 4*a* and 4*b*, the mounting hardware 147 is configured to fixedly attach the second mounting bracket 116 (of the interlocking bracket assembly 112) to the rail-mountable assembly 102, and the mounting hardware 147 is configured to fixedly attach the first mounting bracket 114 (of the interlocking bracket assembly 112) to the sub-mount assembly 110. Of course, in accordance with another option (not depicted but easy to understand nevertheless), the mounting hardware 147 is configured to fixedly attach the first mounting bracket 114 (of the interlocking bracket assembly 112) to the rail-mountable assembly 102, and the mounting hardware 147 is configured to fixedly attach the second mounting bracket 116 (of the interlocking bracket assembly 112) to the sub-mount assembly 110 (if so desired).

In general terms, the first mounting bracket 114 and the second mounting bracket 116 are configured to be selectively slide engageable with each other. The first mounting bracket 114 slides into the second mounting bracket 116 until the first mounting bracket 114 abuts the stop portion 111 (depicted in FIG. 3*e*) of the second mounting bracket 116 and thus stops further travel relative to the second mounting bracket 116; in this way, the first mounting bracket 114 is slide-engaged with the second mounting bracket 116. A lock mechanism (not depicted) may be mounted (if so desired) to the interlocking bracket assembly 112, and may be configured to lock the first mounting bracket 114 and the second mounting bracket 116 together once the first mounting bracket 114 and the second mounting bracket 116 are slide-engaged with each other. For instance, the lock mechanism may include a pin that may be engaged in holes defined by the first mounting bracket 114 and the second mounting bracket 116 once the first mounting bracket 114 and the second mounting bracket 116 are aligned with each other in the slide-engaged position (depicted in FIG. 4*a*).

Referring to both FIGS. 3*e* and 4*a*, the construction of the apparatus 100 is as follows:

Operation (A) includes fixedly connecting the second mounting bracket 116 to the rail-mountable assembly 102, by using the mounting hardware 147 (and corresponding nut) through the fastening holes 117 (depicted in FIG. 3*e*) defined by the second mounting bracket 116 and the fastening holes 146 (depicted in FIG. 3*o*) defined by the rail-mountable assembly 102 (once the fastening holes 117 and the fastening holes 146 are aligned together).

Operation (B) includes fixedly connecting the first mounting bracket 114 to the sub-mount assembly 110, by using the mounting hardware 147 (and corresponding nut) through the fastening holes 123 (depicted in FIG. 3*e*) defined by the first mounting bracket 114 and the fastening holes 128 (depicted in FIG. 3*c*) defined by the sub-mount assembly 110 (once the fastening holes 123 and the fastening holes 128 are aligned together).

Operation (C) includes fixedly attaching the folding assembly 108 to the sub-mount assembly 110 and to the table assembly 104 (using bolts or screws, etc.). As depicted, the first folding portion 127 of the folding assembly 108 is fixedly connected to the table assembly 104; the second folding portion 129 of the folding assembly 108 is fixedly connected to the sub-mount assembly 110.

Operation (D) includes fixedly connecting the rail-mountable assembly 102 to the railings 902. For instance, the rail-mountable assembly 102 is positioned on a selected length of the railings 902 (on a side of the railings 902). The mounting clip 139 is positioned on another side of the railings 902 opposite from the rail-mountable assembly 102. The carriage bolt 145 is positioned to pass through the slot 137 defined by (provided by) the rail-mountable assembly 102 (so that the flared head of the carriage bolt 145 abuts the side of the rail-mountable assembly 102). The carriage bolt 145 slides through the hole 141 defined by the mounting clip 139. The coupling nut 143 is threadably connected to the carriage bolt 145 and is tightened in such a way as to clamp down the rail-mountable assembly 102 to the railings 902. The mounting clip 139 is configured to span across at least two or more adjacently positioned instances of the railings 902 (depending on the requirements for supporting the weight of the apparatus 100 and the weight to be received by the table assembly 104, etc.).

Operation (E) includes slidably engaging the first mounting bracket 114 (that is fixedly attached to the sub-mount assembly 110) with the second mounting bracket 116 (that is fixedly attached to the rail-mountable assembly 102).

Now the table assembly 104 may be selectively moved or positioned between the deployed position as depicted in FIG. 4*a* and the storage position depicted in FIG. 4*b*. It will be appreciated that the table assembly 104 may be securely locked in the deployed position in order to safely secure the weight to be received by the table assembly 104 (from such items as plates, cutlery, etc.).

Figure 4C:
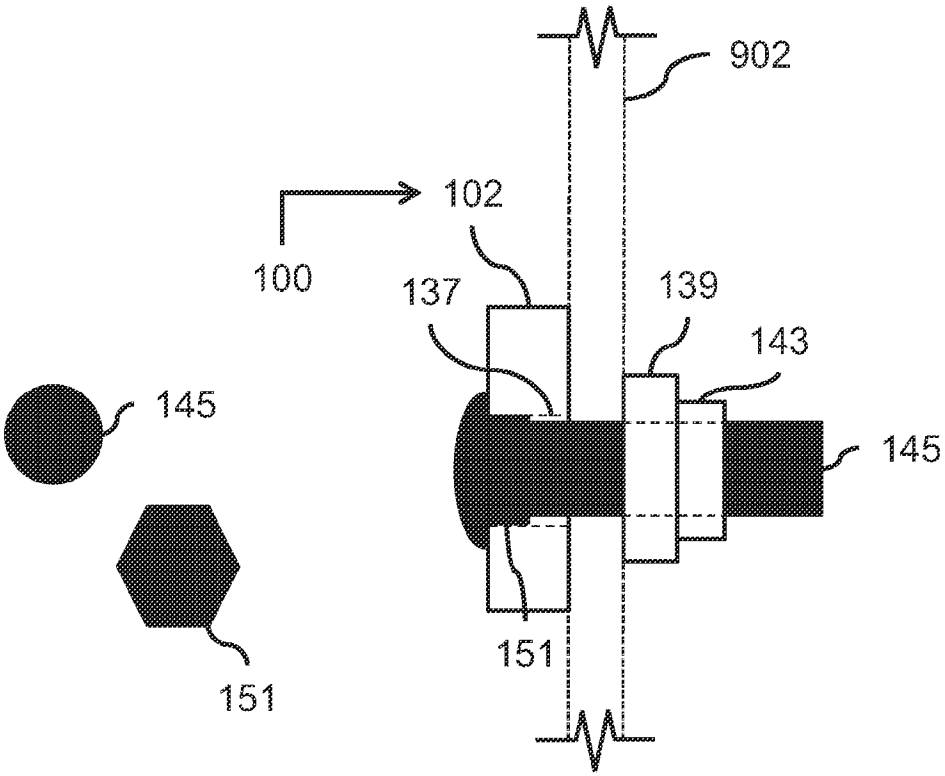
Figure 4D:
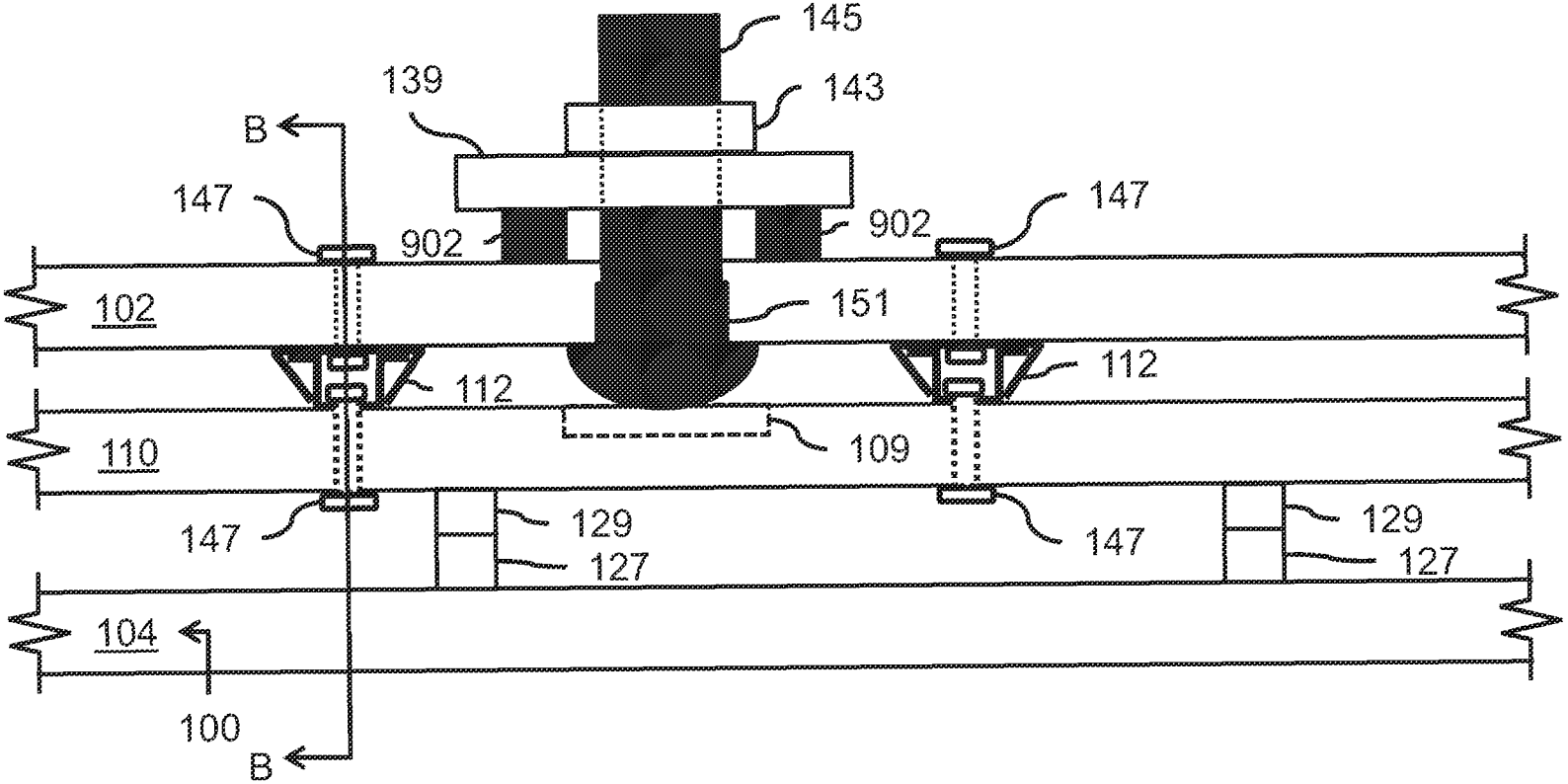
Figure 4E:
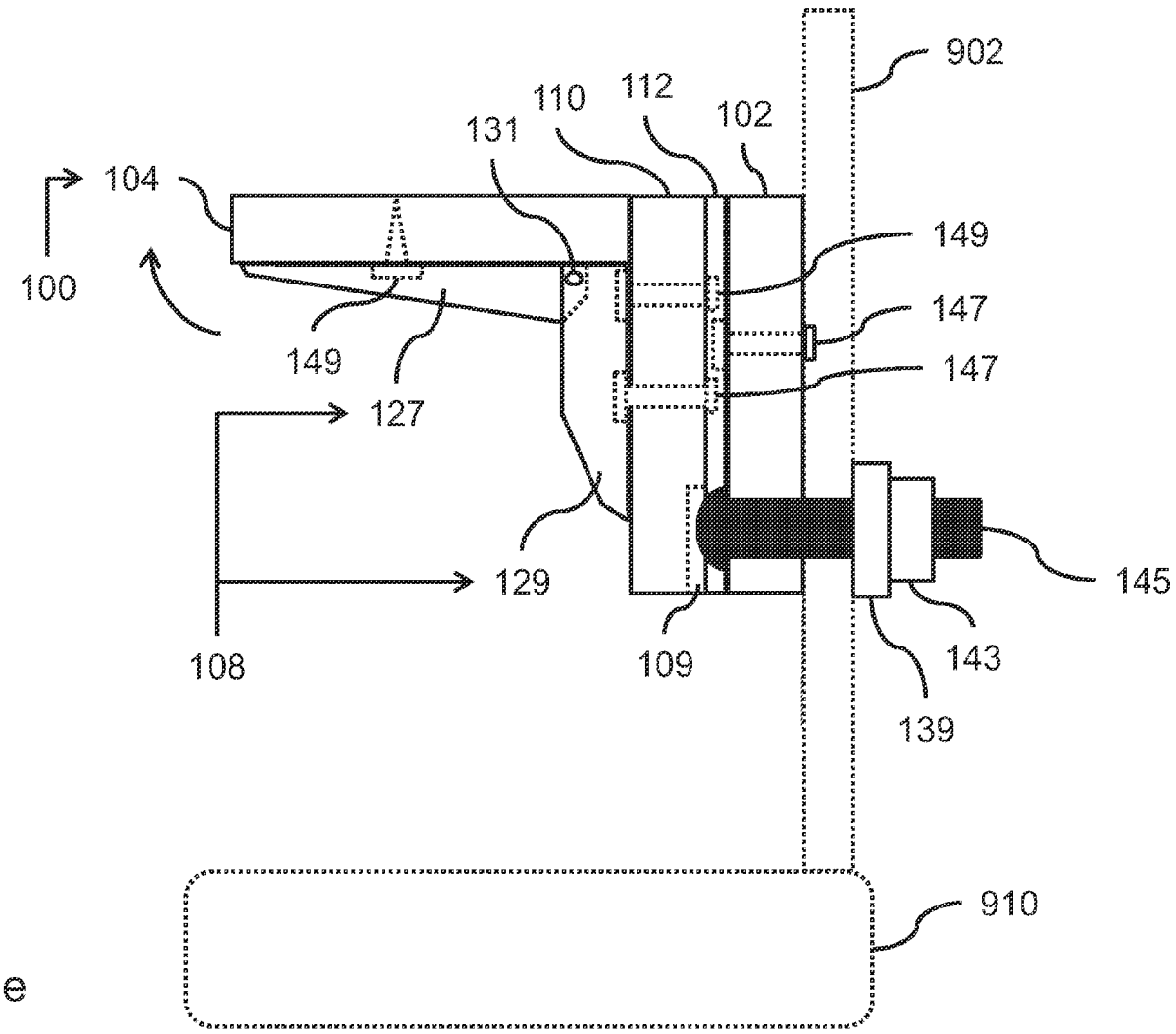

Referring to FIG. 4*c* (depicting a side view) along the line A-A of FIG. 4*b*, there is depicted an embodiment of the carriage bolt 145, the coupling nut 143 and the mounting clip 139 assembled so that the rail-mountable assembly 102 is fixedly attached to the railings 902. The carriage bolt 145 may include a rounded head portion. The head portion of the carriage bolt 145 has a diameter that is larger than the dimension or diameter of the slot 137. The carriage bolt 145 includes a hex portion 151 extending from the head portion. The hex portion 151 (also called a hexagonal-shaped outer surface) is configured to be slidable along the slot 137 between the side walls of the rail-mountable assembly 102 (it will be appreciate that in this manner and arrangement, the carriage bolt 145 does not inadvertently turn or rotate in response to tightening of the coupling nut 143 to the distal end of the carriage bolt 145). It is understood that the hex portion 151 is configured to lock in a position once the hex portion 151 is urged to rotate along the rotation axis extending through the carriage bolt 145. The cross sectional profile of the hex portion 151 is depicted to the left side of FIG. 4*c* (for improved clarity regarding the hex portion 151).

Referring to FIG. 4*d* (depicting a top view), there is depicted an embodiment of the apparatus 100 in which the apparatus 100 is depicted in the storage position. In accordance with an option, the slot 109 is defined by the sub-mount assembly 110 and is positioned proximate to the head of the carriage bolt 145, and the slot 109 is configured to accommodate the round head of the carriage bolt 145 for the case where there may be a possible interference between the head portion of the carriage bolt 145 and the sub-mount assembly 110.

Figure 4F:
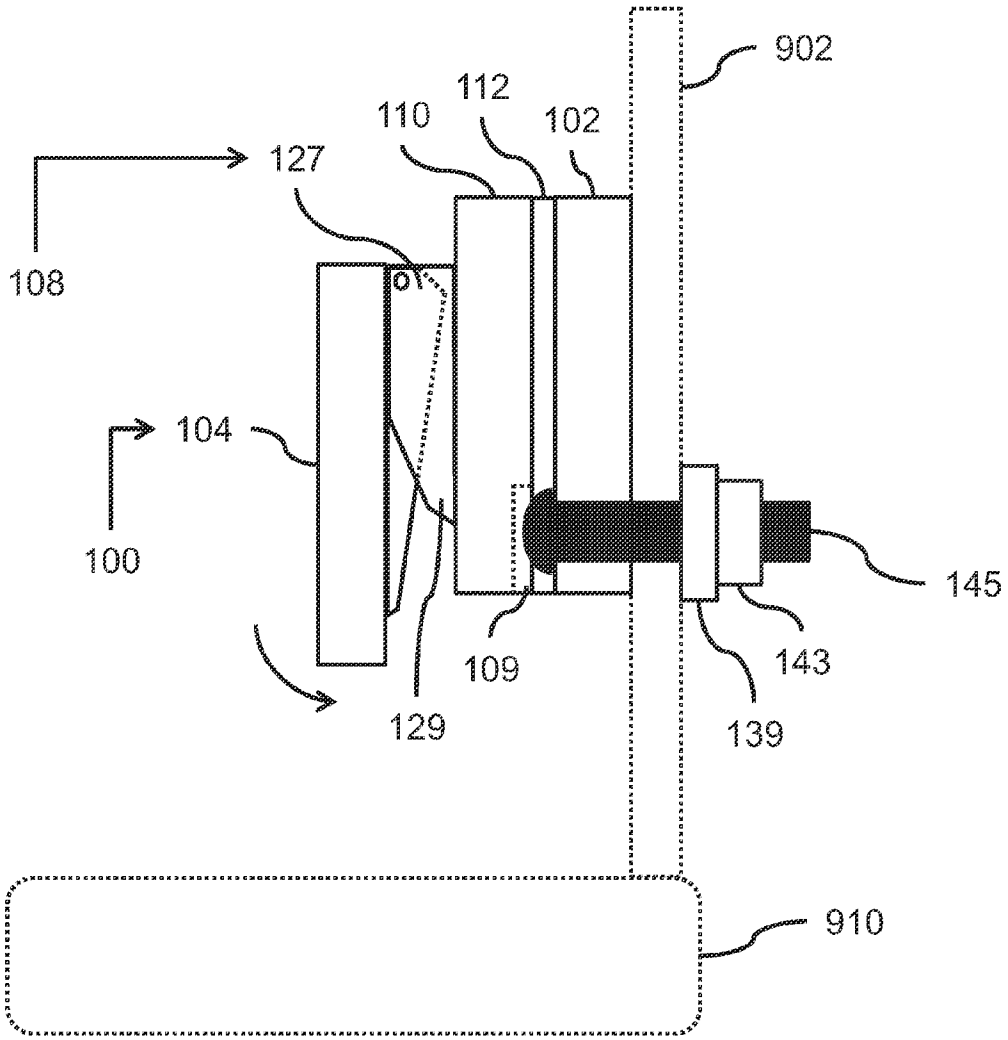

Referring to FIGS. 4*e* and 4*f* (depicting cross-sectional side views through line B-B of FIG. 4*f*), there is depicted an embodiment of the apparatus 100. FIG. 4*e* depicts the table-deployment position of the table assembly 104, in which the table assembly 104 is moved (such as, folded) away from the sub-mount assembly 110 in such a way that space underneath the table assembly 104 is increased, at least in part. In this way, items (such as plates, cutlery, etc.) may be positioned on the table assembly 104, and the table assembly 104 may then receive weight from user items (when desired by the user). FIG. 4*f* depicts the storage position of the table assembly 104, in which the table assembly 104 is moved (folded) towards the sub-mount assembly 110 in such a way that space underneath the table assembly 104 is reduced, at least in part. In this manner, additional space may be provided next to the railings 902 (when desired by the user). It will be appreciated that the vertical height of the rail-mountable assembly 102 and the sub-mount assembly 110 may be the same. The vertical height of the interlocking bracket assembly 112 may vary to be the same as or smaller than the rail-mountable assembly 102.

With reference to FIG. 4*e*, the slot 109 (also depicted in FIG. 3*b*) is defined by the sub-mount assembly 110; the slot 109 is configured to accommodate the flared head of the carriage bolt 145 once the carriage bolt 145 is positioned to clamp the rail-mountable assembly 102 to the railings 902 (in accordance with an option where the flared head of the carriage bolt 145 may be relatively large).

Figure 4G:
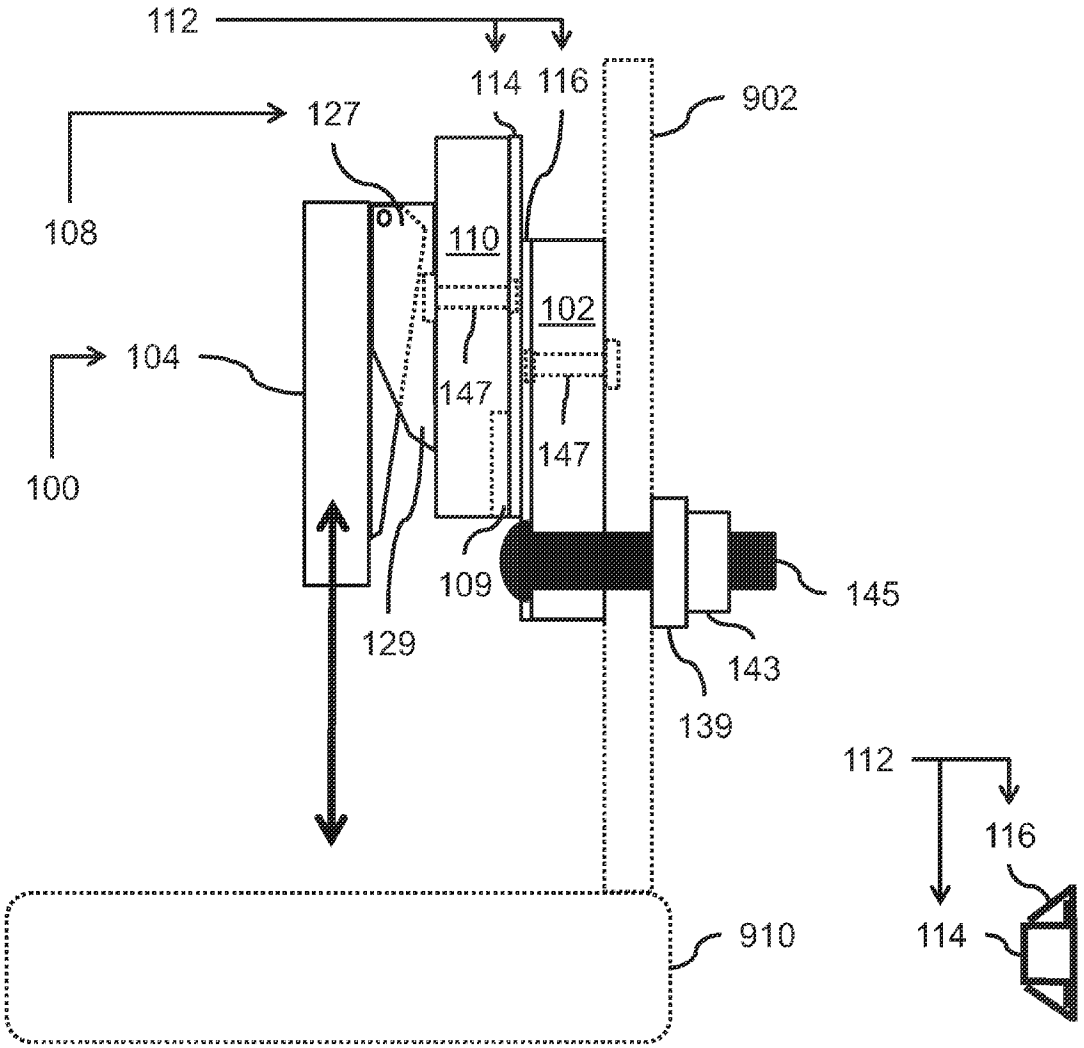

Referring to FIG. 4*g* (depicting a cross-sectional side view through line B-B of FIG. 4*f*), there is depicted an embodiment of the apparatus 100. FIG. 4*g* shows the case where the first mounting bracket 114 and the second mounting bracket 116 of the interlocking bracket assembly 112 are slidably engaging with each other (along a direction that is parallel to the railings 902) along a vertical direction relative to the floor 910. It will be appreciated that once the first mounting bracket 114 and the second mounting bracket 116 are operatively aligned with each other (as depicted in FIG. 4*e*), they may be locked together (if so desired).

Figure 4H:
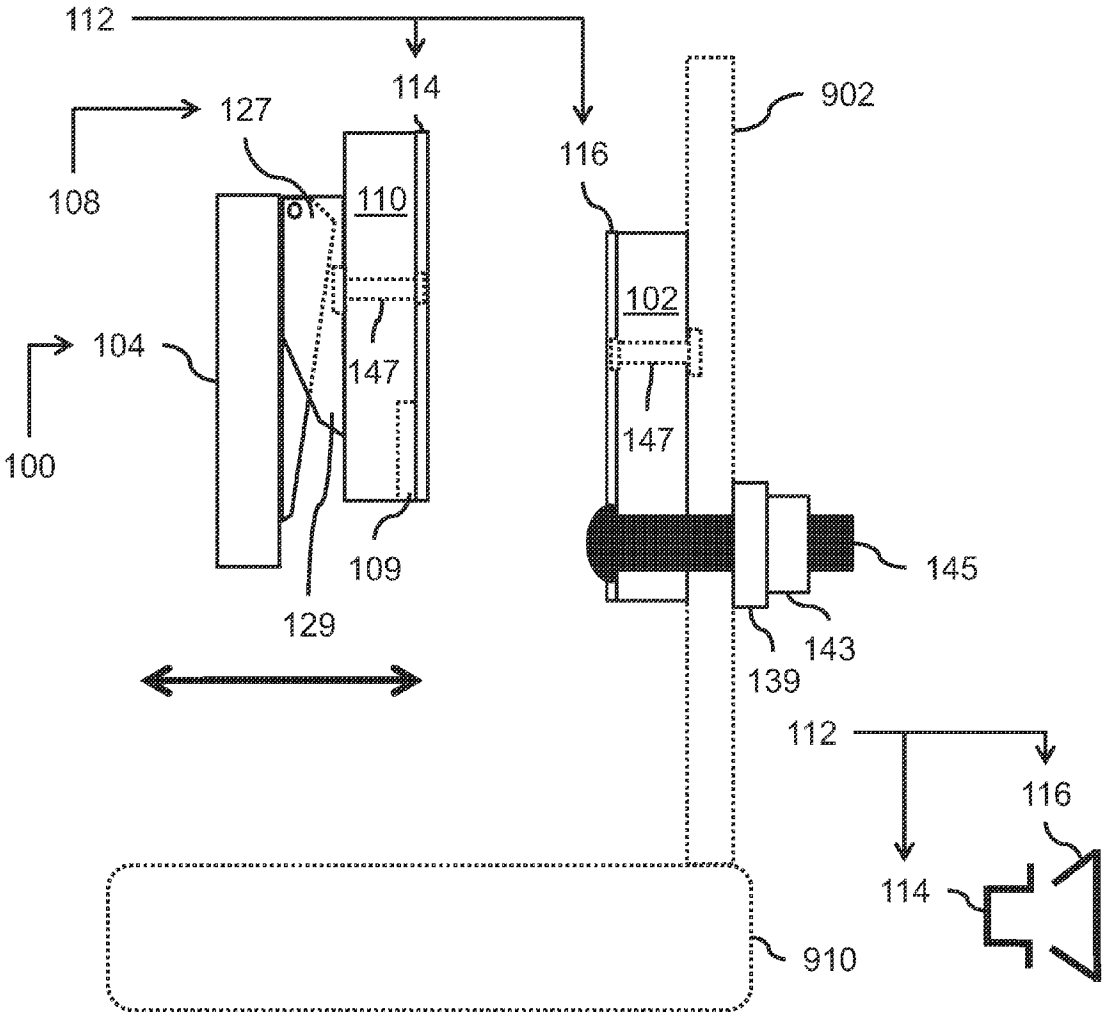

Referring to FIG. 4*h* (depicting a cross-sectional side view through line B-B of FIG. 4*f*), there is depicted an embodiment of the apparatus 100. FIG. 4*h* shows the case where the first mounting bracket 114 and the second mounting bracket 116 of the interlocking bracket assembly 112 are separated from each other. For this case, the table assembly 104 may be placed, for example, in an interior of a house or a garage while the rail-mountable assembly 102 may remain attached to the railing 902. As depicted in FIG. 4*h*, the first mounting bracket 114 and the second mounting bracket 116 are disengaged from each other.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

It may be appreciated that the assemblies and modules described above may be connected with each other as may be required to perform desired functions and tasks that are within the scope of persons of skill in the art to make such combinations and permutations without having to describe each and every one of them in explicit terms. There is no particular assembly, or components, that are superior to any of the equivalents available to the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for the purposes of this document, that the phrase "includes" is equivalent to the word "comprising." It is noted that the foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a rail-mountable assembly configured to be fixedly connected to a selected length of the railings of a handrail system;

a table assembly having a table surface;

a sub-mount assembly;

a folding assembly configured to be fixedly connected to the table assembly, and also configured to be fixedly connected to the sub-mount assembly; and an interlocking bracket assembly, including:

a first mounting bracket configured to be fixedly connected to, and project from, the rail-mountable assembly; and a second mounting bracket configured to be fixedly connected to, and project from, the sub-mount assembly; and the first mounting bracket and the second mounting bracket configured to be selectively engageable with each other; and wherein:

the first mounting bracket and the second mounting bracket are configured to be selectively slide engageable with each other; and the first mounting bracket includes a first base portion, and also includes first longitudinal side rails that extend from opposite sides of the first base portion in such a way as to form a U shaped profile, and opposite ends of the first longitudinal side rails define openings; and the second mounting bracket includes second longitudinal side rails positioned on opposite sides of the second mounting bracket, and also includes a stop portion positioned at an end of the second longitudinal side rails, and also includes an opening defined at the end located opposite to the stop portion, and the opening is positioned at another end of the second longitudinal side rails opposite from the stop portion; and the first longitudinal side rails and the second longitudinal side rails are slide engageable with each other.

2. The apparatus of claim 1, wherein:

the folding assembly is also configured to permit selective foldable movement of the table assembly between a table-deployment position and a table-storage position in response to the folding assembly receiving an application of a force to do just so;

in the table-storage position, the table assembly is moved towards the sub-mount assembly in such a way that space underneath the table assembly is reduced, at least in part; and in the table-deployment position, the table assembly is moved away from the sub-mount assembly in such a way that space underneath the table assembly is increased, at least in part.

3. An apparatus, comprising:

a rail-mountable assembly configured to be fixedly connected to a selected length of the railings of a handrail system;

a table assembly having a table surface;

a sub-mount assembly;

a folding assembly configured to be fixedly connected to the table assembly, and also configured to be fixedly connected to the sub-mount assembly; and an interlocking bracket assembly, including:

a first mounting bracket configured to be fixedly connected to, and project from, the rail-mountable assembly; and a second mounting bracket configured to be fixedly connected to, and project from, the sub-mount assembly; and the first mounting bracket and the second mounting bracket configured to be selectively engageable with each other; and wherein:

the first mounting bracket and the second mounting bracket are each configured to support a vertical load;

the first mounting bracket includes a first base portion, and also includes first longitudinal side rails that extend from opposite sides of the first base portion in such a way as to form a U shaped profile, and opposite ends of the first longitudinal side rails define openings; and the second mounting bracket includes second longitudinal side rails positioned on opposite sides of the second mounting bracket, and also includes a stop portion positioned at an end of the second longitudinal side rails, and also includes an opening defined at the end located opposite to the stop portion, and the opening is positioned at another end of the second longitudinal side rails opposite from the stop portion; and the first longitudinal side rails and the second longitudinal side rails are slide engageable with each other; and the first mounting bracket and the second mounting bracket are slide engageable with each other in such a way that:

the rail-mountable assembly and the second mounting bracket are engaged with each other in an engagement position in which the first mounting bracket remains fixedly connected to the rail-mountable assembly, the second mounting bracket remains fixedly connected to the sub-mount assembly, and the rail-mountable assembly and the second mounting bracket are engaged with each other; and the rail-mountable assembly and the second mounting bracket are disengageable from each other in a disengagement position in which the first mounting bracket remains fixedly connected to the rail-mountable assembly, the second mounting bracket remains fixedly connected to the sub-mount assembly, and the rail-mountable assembly and the second mounting bracket are disengaged from each other.

4. The apparatus of claim 3, wherein:

the folding assembly includes:

a first folding portion configured to be fixedly connected to the table assembly; and a second folding portion configured to be fixedly connected to the sub-mount assembly; and the first folding portion and the second folding portion are pivotally connected together at a pivot, and the first folding portion and the second folding portion are configured to be pivotally movable relative to each other at the pivot between a table-deployment position and a table-storage position.

5. The apparatus of claim 1, wherein:

the first mounting bracket and the second mounting bracket are configured to transfer weight from the table assembly, the folding assembly and the sub-mount assembly toward the rail-mountable assembly and the railings of the handrail system in such a way that the table assembly remains operatively supported at a table-storage position and at a table-deployment position.

6. The apparatus of claim 1, wherein:

the table assembly has a rectangular shape.

7. The apparatus of claim 1, wherein:
the sub-mount assembly has a length equal to the length of the table assembly.
8. The apparatus of claim 1, wherein:
the sub-mount assembly has a rectangular shape.
9. The apparatus of claim 1, wherein:
the first mounting bracket includes a male portion; and
the second mounting bracket includes a female portion.
10. An apparatus, comprising:
a rail-mountable assembly configured to be fixedly connected to a selected length of the railings of a handrail system;
a table assembly having a table surface;
a sub-mount assembly;
a folding assembly configured to be fixedly connected to the table assembly, and also configured to be fixedly connected to the sub-mount assembly; and
an interlocking bracket assembly, including:
a first mounting bracket configured to be fixedly connected to, and project from, the rail-mountable assembly; and
a second mounting bracket configured to be fixedly connected to, and project from, the sub-mount assembly; and
the first mounting bracket and the second mounting bracket configured to be selectively engageable with each other; and
wherein:
the second mounting bracket includes:
second longitudinal side rails being positioned on opposite sides of the second mounting bracket;
a stop portion being positioned at an end of the second longitudinal side rails;
an opening being defined at the end located opposite to the stop portion, and the opening being positioned at another end of the second longitudinal side rails opposite from the stop portion; and
a second base portion extending between the second longitudinal side rails.
11. The apparatus of claim 10, wherein:
the first mounting bracket includes:
a first base portion; and
first longitudinal side rails extending from opposite sides of the first base portion; and
wherein the first longitudinal side rails extend from opposite sides of the first base portion in such a way as to form a U shaped profile, and opposite ends of the first longitudinal side rails define openings.
12. The apparatus of claim 11, wherein:
the folding assembly includes:
a first folding portion configured to be fixedly connected to the table assembly; and
a second folding portion configured to be fixedly connected to the sub-mount assembly; and
the first folding portion and the second folding portion are pivotally connected together at a pivot, and the first folding portion and the second folding portion are configured to be pivotally movable relative to each other at the pivot between a table-deployment position and a table-storage position.
13. The apparatus of claim 10, wherein:
the folding assembly includes:
a first folding portion configured to be fixedly connected to the table assembly; and
a second folding portion configured to be fixedly connected to the sub-mount assembly; and
the first folding portion and the second folding portion are pivotally connected together at a pivot, and the first folding portion and the second folding portion are configured to be pivotally movable relative to each other at the pivot between a table-deployment position and a table-storage position.
14. The apparatus of claim 1, wherein:
the folding assembly includes:
a first folding portion configured to be fixedly connected to the table assembly; and
a second folding portion configured to be fixedly connected to the sub-mount assembly.
15. The apparatus of claim 14, wherein:
the first folding portion and the second folding portion are pivotally connected together at a pivot, and the first folding portion and the second folding portion are configured to be pivotally movable relative to each other at the pivot between a table-deployment position and a table-storage position.
16. The apparatus of claim 14, wherein:
the first folding portion and the second folding portion are configured to permit selective foldable movement of the table assembly between a table-deployment position and a table-storage position in response to the folding assembly receiving an application of a force to do just so.
17. The apparatus of claim 1, wherein:
instances of the interlocking bracket assembly are spaced apart and are mounted to a table-facing side of the rail-mountable assembly.
18. The apparatus of claim 1, wherein:
the rail-mountable assembly defines a set of slots spaced apart from each other and aligned in a row with each other; and
each slot of the set of slots is elongated and is configured to permit accommodation of different types and sizes of the railings of the handrail system.
19. The apparatus of claim 1, wherein:
the rail-mountable assembly includes:
a coupling nut;
a carriage bolt including a shaft portion defining threads configured to mate with the coupling nut, and also includes a flared head portion extending from a shaft portion of the carriage bolt; and
a mounting clip defining a hole dimensioned to receive the carriage bolt; and
the mounting clip, the coupling nut and the carriage bolt, in combination, are configured to fixedly connect the rail-mountable assembly to the railings.
20. The apparatus of claim 19, wherein:
the carriage bolt is configured to pass through, at least in part, a slot provided by the rail-mountable assembly so that a flared head of the carriage bolt abuts the side of the rail-mountable assembly;
the flared head portion of the carriage bolt abuts a table-facing side of the rail-mountable assembly;
the shaft portion of the carriage bolt extends through the slot;
the mounting clip is positioned on the selected length of the railings;
the mounting clip is configured to span across, and abut with, at least two adjacently located instances of the railings;
the shaft portion of the carriage bolt extends through the hole of the mounting clip;
the coupling nut is threadably connected to the shaft portion of the carriage bolt; and the coupling nut is turned in such a way that a clamping force is imparted to the mounting clip, and the railings are forcibly clamped or sandwiched between the mounting clip and the rail-mountable assembly.

* * * * *